US009663877B2

(12) United States Patent
Zhang

(10) Patent No.: US 9,663,877 B2
(45) Date of Patent: May 30, 2017

(54) CARD WIRE

(71) Applicant: GROZ-BECKERT KOMMANDIT-GESELLSCHAFT, Albstadt (DE)

(72) Inventor: Yuning Zhang, Wuxi (CN)

(73) Assignee: GROZ-BECKERT KG, Albstadt (DE)

( * ) Notice: Subject to any disclaimer, the term of this patent is extended or adjusted under 35 U.S.C. 154(b) by 0 days.

(21) Appl. No.: 15/111,726

(22) PCT Filed: Jan. 12, 2015

(86) PCT No.: PCT/EP2015/050407

§ 371 (c)(1),
(2) Date: Jul. 14, 2016

(87) PCT Pub. No.: WO2015/110304

PCT Pub. Date: Jul. 30, 2015

(65) Prior Publication Data

US 2016/0348285 A1 Dec. 1, 2016

(30) Foreign Application Priority Data

Jan. 23, 2014 (EP) ..... 14152310

(51) Int. Cl.
*D01G 15/88* (2006.01)
*D01G 15/46* (2006.01)

(52) U.S. Cl.
CPC ..... *D01G 15/88* (2013.01); *D01G 15/46* (2013.01)

(58) Field of Classification Search
CPC ..... D01G 15/84; D01G 15/88
(Continued)

(56) References Cited

U.S. PATENT DOCUMENTS 2,937,413 A * 5/1960 Hollingsworth ..... B23D 61/121 19/114
5,581,848 A * 12/1996 Egerer ..... D01G 19/10 19/113

(Continued)

FOREIGN PATENT DOCUMENTS

CN 1420216 A 5/2003
CN 2739200 Y 11/2005

(Continued)

OTHER PUBLICATIONS

International Search Report and Written Opinion for corresponding International Application No. PCT/EP2015/050407, dated Mar. 26, 2015, 9 pages.

(Continued)

*Primary Examiner* — Shaun R Hurley
(74) *Attorney, Agent, or Firm* — Fitch, Even, Tabin & Flannery LLP

(57) ABSTRACT

The card wire comprises a plurality of teeth inclined at an angle with the rib portion. The teeth have a front portion and a back portion joining at the tip of the teeth; and a base segment connecting the front portion to the back portion of the preceding tooth. The front portion is the inner portion of the tooth leaning towards the rib portion. The back portion is the outer portion of the tooth. The front portion comprises at least two undercut segments. The second undercut segment is spaced further away from the tip of the tooth than the first undercut segment. Each undercut segment has an undercut angle, being the minimum of the angles with the longitudinal direction of the card wire, of the tangents to each point of the part of the undercut segment going—when observed from the tip—inwards from the front portion.

16 Claims, 5 Drawing Sheets

(58) Field of Classification Search
USPC ..... 19/114; D15/78
See application file for complete search history.

(56) References Cited

U.S. PATENT DOCUMENTS

| | | | | |
|---|---|---|---|---|
| 6,408,487 | B1 * | 6/2002 | Atkinson | D01G 15/88 19/114 |
| 9,145,625 | B2 * | 9/2015 | Zhang | D01G 15/88 |
| 2004/0154137 | A1 | 8/2004 | Bauersachs | |
| 2013/0042437 | A1 * | 2/2013 | Vangheluwe | D01G 15/88 19/144 |
| 2013/0133159 | A1 | 5/2013 | Vangheluwe | |
| 2014/0338154 | A1 * | 11/2014 | Zhang | D01G 15/88 19/99 |

FOREIGN PATENT DOCUMENTS

| | | | |
|---|---|---|---|
| CN | 102869821 | A | 1/2013 |
| CN | 103069061 | A | 4/2013 |
| WO | WO0026450 | A1 | 5/2000 |
| WO | 2011138322 | A1 | 11/2011 |
| WO | 2013037711 | A1 | 3/2013 |

OTHER PUBLICATIONS

Office action in corresponding Korean Application No. 10-2016-7011012, dated Sep. 5, 2016, 6 pages.
European Search Report in corresponding European Application No. 14 15 2310, dated May 7, 2014, 4 pages.
First search in corresponding Chinese Application No. CN2015800055990, dated Mar. 6, 2017, 1 page.

* cited by examiner

CARD WIRE

CROSS REFERENCE TO RELATED APPLICATIONS

This patent application is the national phase of PCT/EP2015/050407 filed Jan. 12, 2015, which claims the benefit of European Patent Application No. 14152310.0 filed Jan. 23, 2014.

TECHNICAL FIELD

The invention relates to a card wire, e.g. for use on condenser rollers on nonwoven cards, to apparatuses using such card wires on condenser rollers, and to nonwoven cards equipped with such apparatuses.

BACKGROUND

The use of one or more consecutive condenser rollers on nonwoven cards is known. US2004/0154137A1, for instance, describes a nonwoven card provided with condenser rollers, also called stuffer rollers. Condenser rollers are positioned immediately downstream of a doffer roller. The doffer roller is taking the web from a main cylinder or from a randomizing roller. The doffer roller transfers the fiber web to a condenser roller. Because of the lower surface velocity of the condenser roller compared to the doffer roller, the fiber web is condensed, meaning it increases in weight per unit of surface area; and the fiber orientation in the web is affected. It is possible that a second condenser roller is installed to take off the web from the first condenser roller. Such second condenser roller has a lower surface speed than the first condenser roller, resulting in a further condensing of the fiber web. Typically, a take-off roller is taking off the fiber web from the last condenser roller. The take-off roller is normally the last roller on the nonwoven card covered with card wire.

The condenser roller or condenser rollers are provided with a specific type of card wire. The wires are mounted on the condenser rollers such that the tips of the teeth are oriented in the direction opposite to the rotation of the condenser roller. Card wires for condenser rollers mostly have a relatively large height, a rather large tooth depth, a slender tooth and a large pitch between teeth in order to be able to accommodate the amount of fibers of fiber web being produced.

WO2013/037711A1 discloses a card wire comprising an elongated rib portion and teeth. The teeth have a front portion and a back portion. The teeth hang over towards their front portion. The front portion and back portion merge at the tip of the tooth. The front portion comprises at least three sections: a first section extends from the tip of the tooth in the direction of the rib portion, a second section extends below the first section in the direction of the rib portion and a third section extends from the end of the second section in the direction of the rib portion. The second section comprises a straight part and a curved segment, wherein the straight part has a minimum length of 0.10 mm and the straight part has an angle between 10 and 30 degrees relative to the length direction of the card wire. The straight part is followed by the curved segment wherein the curved segment has a radius of at least 0.18 mm. The front portion can comprise downwards towards the rib portion of the second section at least one additional such second section. The document mentions the use of such card wires on condenser rollers of nonwoven cards.

US2013/133159A discloses a wire profile with a rib portion and a plurality of teeth over the length of the rib portion. The plurality of teeth is inclined at an angle with respect to the rib portion. The teeth have a front portion and a back portion. The front portion is the inner portion of the teeth leaning towards the rib portion and the back portion is the outer portion of the teeth. At least one tooth comprises at least one nose cut segment in its back portion. The wire can be beneficially used for covering condenser rollers.

WO2011/138322A1 discloses a wire profile for card clothing comprising a rib portion and plurality of teeth over the length of the rib portion. The teeth are sloped with a back slope representing the backbone of the teeth and a front slope representing the side in direct contact with fibers. The back slope has a tangent forming a back angle with the rib portion. The front slope is divided into at least two segments, a tip segment and an undercut segment to retain the fibers. The tip segment converges with the back slope to form a tip of the teeth wherein the tip segment serves to penetrate between fibers and wherein the tip segment has a tangent forming a tip angle with the rib portion. The undercut segment has a tangent forming an undercut angle with the rib portion; the undercut angle is at each point in the undercut segment larger than the maximum of the back angle and smaller than the smallest value of the tip angle.

SUMMARY

The primary objective of the invention is to provide an improved card wire for condenser rollers on nonwoven cards, in order to produce fiber webs which do not show an irregularly undulating appearance. It is a further objective of the invention to provide apparatuses comprising rollers covered with such card wires.

A first aspect of the invention is a card wire, e.g. for condenser rollers of nonwoven cards. The card wire comprises a rib portion and a plurality of teeth along the length of the rib portion. The plurality of teeth are inclined at an angle with respect to the rib portion. The teeth have a front portion and a back portion. The front portion is the inner portion of the tooth leaning towards the rib portion. The back portion is the outer portion of the tooth. The front portion and the back portion of the tooth join at the tip of the tooth. The teeth have a base segment, connecting the front portion of a tooth to the back portion of the preceding tooth. The front portion comprises at least two undercut segments; a first undercut segment and a second undercut segment. The second undercut segment is spaced further away from the tip of the tooth than the first undercut segment. Each undercut segment has an undercut angle. The undercut angle is the minimum of the angles with the longitudinal direction of the card wire, of the tangents to each point of the part of the undercut segment going—when observed from the tip—inwards from the front portion. The second undercut segment has a larger undercut angle than the first undercut segment.

Prior art wires used on condenser rollers on nonwoven cards have shown problems. The fiber web that is detached from the doffer roller and transferred onto the first condenser roller; and/or from the first condenser roller onto the second condenser roller can show over its surface an irregularly undulating appearance.

It is a benefit of the invention that fiber webs can be manufactured without the mentioned appearance problem and without the occurrence of fiber loading on the card wires on the condenser rollers when using the card wires of the invention on condenser rollers. The avoidance of irregularly undulating appearance of the fiber web with the card wire of the invention is believed to be created by a channelling effect, reorienting the fibers.

Examples of "undercut segments" are segments of the front portion of the tooth of the card wire, starting at a vertex—or at a vertex that has a rounded shape—of a convex section of the front portion, and going—observed along the front portion in the direction from the tip to the base segment—inwards in the tooth.

Preferably, the difference between the undercut angle of the second undercut segment and the undercut angle of the first undercut segment is at least 8 degrees, preferably at least 12 degrees, more preferably at least 15 degrees; and preferably less than 20 degrees, more preferably less than 15 degrees.

In preferred card wires, the first undercut segment starts at a distance—measured perpendicularly to the longitudinal direction of the card wire—from the tip of the tooth, of at least 0.15 mm; more preferably of at least 0.2 mm; more preferably of at least 0.3 mm, even more preferably of at least 0.5 mm. Such embodiments have shown to eliminate the irregular undulations in the fiber web during a long lifetime of the card wire on the condenser rollers.

In preferred card wires, the undercut angle of the first undercut segment is between 0 and 38 degrees, preferably between 0 and 25 degrees, more preferably between 12 and 25 degrees.

Preferably, the undercut angle of the second undercut segment is between 20 and 50 degrees, more preferably between 20 and 38 degrees.

Further preferred card wires comprise a third undercut segment positioned further away from the tip of the tooth than the second undercut segment. The third undercut segment has an undercut angle which is larger than the undercut angle of the second undercut segment.

Preferably, the undercut angle of the third undercut segment is at least 8 degrees, preferably at least 12 degrees, more preferably at least 15 degrees; and preferably less than 20 degrees, more preferably less than 15 degrees, larger than the undercut angle of the second undercut segment.

Preferably, the undercut angle of the third undercut segment is between 30 and 50 degrees, more preferably between 35 and 50 degrees.

Preferred card wires comprise between the tip and the first undercut segment a linear part in the front portion. Preferably, that linear part of the front portion has an angle with the rib portion of the card wire between 20 and 65 degrees, preferably between 20 and 40 degrees, more preferably between 20 and 30 degrees; e.g. 22 degrees; or between 50 and 65 degrees, e.g. 60 degrees.

In a further preferred embodiment, the front portion comprises between the tip and the first undercut segment two linear portions; preferably wherein the linear portion closest to the tip has a smaller angle with the longitudinal direction of the card wire than the second linear portion. The linear portion closest to the tip e.g. has an angle between 20 and 30 degrees with the longitudinal direction of the card wire. The second linear portion e.g. has an angle between 50 and 65 degrees with the longitudinal direction of the card wire.

In a preferred card wire, the first undercut segment and/or the second undercut segment; or the first undercut segment and/or the second undercut segment and/or if present a third undercut segment positioned further away from the tip of the tooth than the second undercut segment; comprise in the part of the undercut segment going—when observed from the tip—inwards from the front portion a part that is substantially linear. The linear part preferably has a length of at least 0.2 mm, more preferably of at least 0.4 mm, even more preferably of at least 0.6 mm, and still even more preferably of at least 0.8 mm.

In preferred card wires, the first undercut segment and/or the second undercut segment; or the first undercut segment and/or the second undercut segment and/or if present a third undercut segment positioned further away from the tip of the tooth than the second undercut segment; have a triangular shape or a scallop shape. The triangular shape can be a triangular shape with rounded tips of the triangle.

A second aspect of the invention is an apparatus comprising a roller, preferably a condenser roller. The roller is covered with a card wire as in the first aspect of the invention. The roller is arranged to rotate in the direction opposite to the orientation of the front portion of the teeth of the card wire on the roller.

A preferred apparatus comprises a further roller covered with card wire.

The further roller is arranged to rotate in the direction so that the surface of the further roller closest to the surface of the roller covered with the card wire as in the first aspect of the invention and the surface of the roller covered with the card wire as in the first aspect of the invention closest to the surface of the further roller rotate in the same tangential direction; and the roller covered with the card wire as in the first aspect of the invention is arranged to receive a web of fibers from the further roller. Preferably the roller covered with the card wire as in the first aspect of the invention is arranged to rotate at a lower surface speed than the further roller, preferably at a surface speed that is at least 20% lower. Preferably, the further roller is arranged to transfer the complete web on its surface onto the roller covered with the card wire of the first aspect of the invention. Preferably, the further roller is arranged to rotate in the direction opposite to the orientation of the front portion of the teeth of the card wire on the roller.

In a further preferred embodiment, the apparatus comprises a third roller comprising card wire. The third roller is arranged to rotate in tangential direction opposite to the further roller. The third roller is arranged to transfer its web at least partially onto a further roller.

The apparatus of the second aspect of the invention has been seen to be particularly beneficial in reducing the irregularly undulating appearance that can occur with prior art wires when detaching the fiber web from the doffer roller or from the first condenser roller.

In an exemplary embodiment, the apparatus is a nonwoven card. The roller covered with card wire of the first aspect of the invention can be a first condenser roller, which is the roller immediately downstream of a doffer roller; or can be a second condenser roller, which is a condenser roller immediately downstream of a first condenser roller.

Preferably, where two condenser rollers are used, the ratio of the point density (expressed in tips of card wire per unit of surface area of the roller) of the first condenser roller to the point density of the second condenser roller is between 1 and 2, or between 1.5 and 3. A range between 1 and 2 is e.g. preferred for the combination of first and second condenser rollers.

A ratio of the point density of the doffer roller to the condenser roller between 1.5 and 3 is preferred.

In further preferred embodiments, the first and the second condenser roller are covered with card wire according to the first aspect of the invention.

A third aspect of the invention is a method of operating an apparatus according to the second aspect of the invention. A condenser roller covered with card wire of the first aspect of the invention rotates at a lower surface speed than the further roller. The condenser roller receives the full web of fibers present on the further roller. With "the condenser roller receives the full web of fibers present on the further roller" is meant that substantially no fibers remain on the further roller after the fiber transfer.

Preferably, the condenser roller rotates at a lower surface speed than the further roller, preferably at a surface speed that is at least 20% lower. Preferably, the further roller rotates in the direction opposite to the orientation of the front portion of the teeth of the card wire on the roller.

Preferably, the apparatus used in the method comprises a third roller comprising card wire. The third roller rotates in tangential direction opposite to the direction of rotation of the further roller; and with a higher surface speed than the further roller. The third roller transfers the fiber web on it at least partially onto the further roller.

In such embodiment, the third roller can e.g. be a cylinder roller or a randomizing roller. The further roller can be a doffer roller.

The method of the invention allows making a high quality condensed fiber web.

Features of different embodiments and of different examples can be combined while staying within the scope and content of the invention.

DETAILED DESCRIPTION

Figure 1:
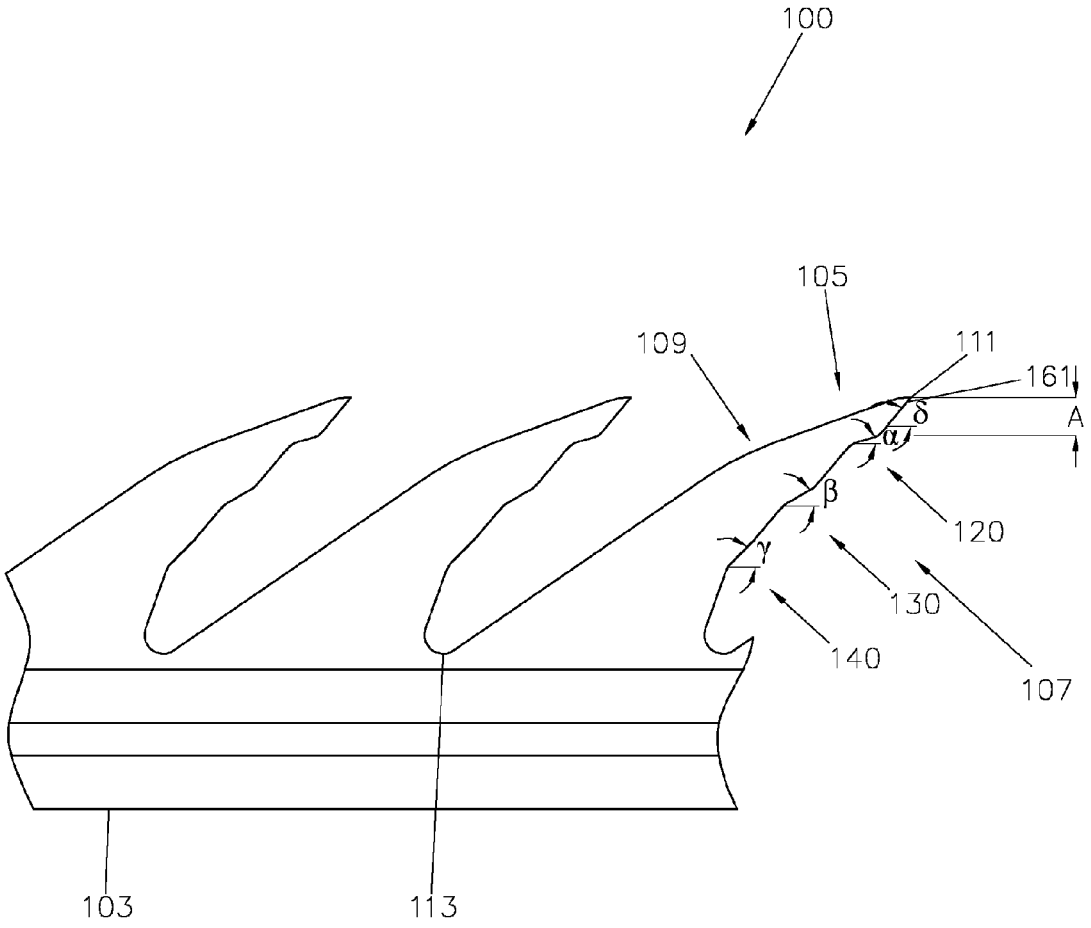
FIG. 1 shows a card wire according to the invention.

FIG. 1 shows a card wire 100 according to the invention. The card wire 100 comprises a rib portion 103 and a plurality of teeth 105 along the length of the rib portion 103. The plurality of teeth 105 are inclined at an angle with respect to the rib portion 103. The teeth have a front portion 107 and a back portion 109. The front portion 107 is the inner portion of the tooth 105 leaning towards the rib portion 103. The back portion 109 is the outer portion of the tooth. The front portion 107 and the back portion 109 of the tooth join at the tip 111 of the tooth. The base segment 113 connects the front portion to the back portion 109 of the preceding tooth. FIG. 1 shows a card wire 100 where the teeth 105 have a front portion 107 comprising three undercut segments. A first undercut segment 120, a second undercut segment 130 and a third undercut segment 140. The undercut segments 120, 130, 140 have a triangular shape with rounded tips of the triangle. Each undercut segment 120, 130, 140 has an undercut angle. The undercut angle is the minimum of the angles with the longitudinal direction of the card wire, of the tangents to each point of the part of the undercut segment going—when observed from the tip—inwards from the front portion. The first (120), second (130) and third (140) undercut segment respectively have undercut angles $\alpha$, $\beta$ and $\gamma$. As an example, $\alpha$ is 15 degrees, $\beta$ is 27 degrees and $\gamma$ is 40 degrees. In another example $\alpha$ is 15 degrees, $\beta$ is 20 degrees and $\gamma$ is 40 degrees. In another example $\alpha$ is 15 degrees, $\beta$ is 35 degrees and $\gamma$ is 50 degrees. In another example $\alpha$ is 15 degrees, $\beta$ is 35 degrees and $\gamma$ is 45 degrees.

In another example $\alpha$ is 0 degrees, $\beta$ is 12 degrees and $\gamma$ is 35 degrees. In another example $\alpha$ is 8 degrees, $\beta$ is 20 degrees and $\gamma$ is 45 degrees. In another example $\alpha$ is 35 degrees, $\gamma$ is 43 degrees and $\gamma$ is 50 degrees.

In another example, the card wire has a first undercut segment with an undercut angle 20 degrees and a second undercut segment with undercut segment 35 degrees.

In the example of FIG. 1, the first undercut segment starts at a distance A—measured perpendicularly to the longitudinal direction of the card wire—from the tip of the tooth of 0.6 mm.

The exemplary card wire 100 shown in FIG. 1 comprises between the tip 111 and the first undercut segment 120 a linear part 161 in the front portion 107. The linear part 161 has a smallest angle $\delta$ with the rib portion 103 of 60 degrees. In other examples, the linear part 161 has a smallest angle $\delta$ with the rib portion 103 of e.g. 55 or 50 degrees.

Figure 2:
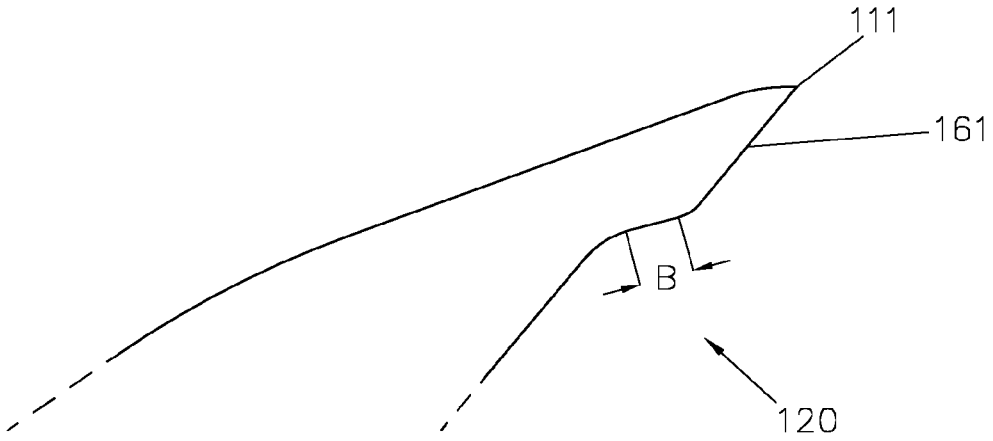
FIG. 2 shows a detail of the card wire of FIG. 1.

The first (120), second (130) and third (140) undercut comprise in the part of the undercut segment going—when observed from the tip—inwards from the front portion a part that is substantially linear. This is illustrated for the first undercut segment 120 in FIG. 2 which is showing a detail of the card wire 100 of FIG. 1. Same reference numerals of FIGS. 1 and 2 have the same meaning. The linear part B preferably has a length between 0.4 mm and 1 mm, e.g. 0.8 mm.

Figure 3:
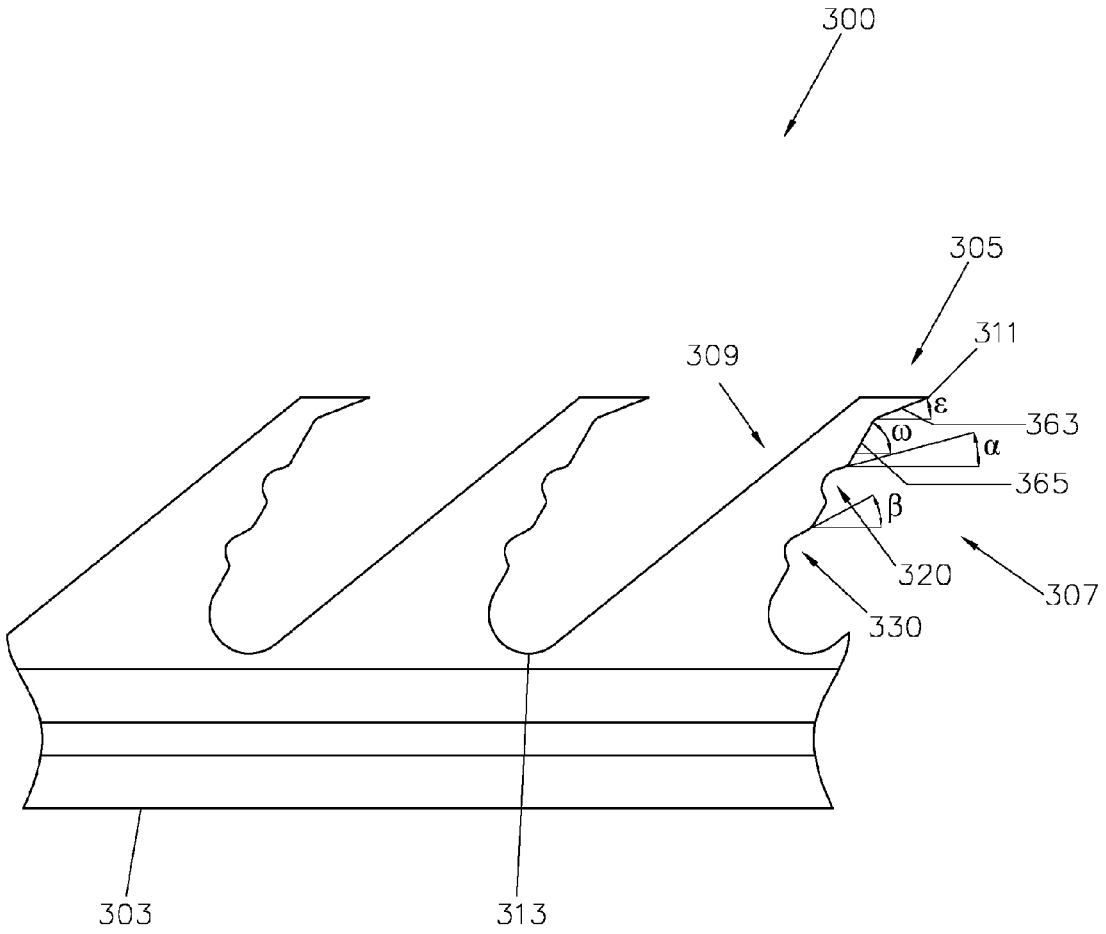
FIG. 3 shows another card wire according to the invention.

FIG. 3 shows a card wire 300 according to the invention of which the two undercut segments 320 and 330 have a scallop shape. The card wire 300 comprises a rib portion 303 and a plurality of teeth 305 along the length of the rib portion 303. The plurality of teeth 305 are inclined at an angle with respect to the rib portion 303. The teeth have a front portion 307 and a back portion 309. The front portion 307 is the inner portion of the tooth 305 leaning towards the rib portion 303. The back portion 309 is the outer portion of the tooth. The front portion 307 and the back portion 309 of the tooth join at the tip 311 of the tooth. The base segment 313 connects the front portion to the back portion of the preceding tooth.

As an example the undercut angles are $\alpha$ equal to 15 degrees and $\beta$ equal to 28 degrees.

The front portion 307 comprises between the tip 311 and the first undercut segment 320 two linear portions 363, 365. The linear portion 363 closest to the tip has an angle $\epsilon$ e.g. 22 degrees and the second linear portion 365 has an angle $\omega$ e.g. 60 degrees with the longitudinal direction of the card wire.

Figure 4:
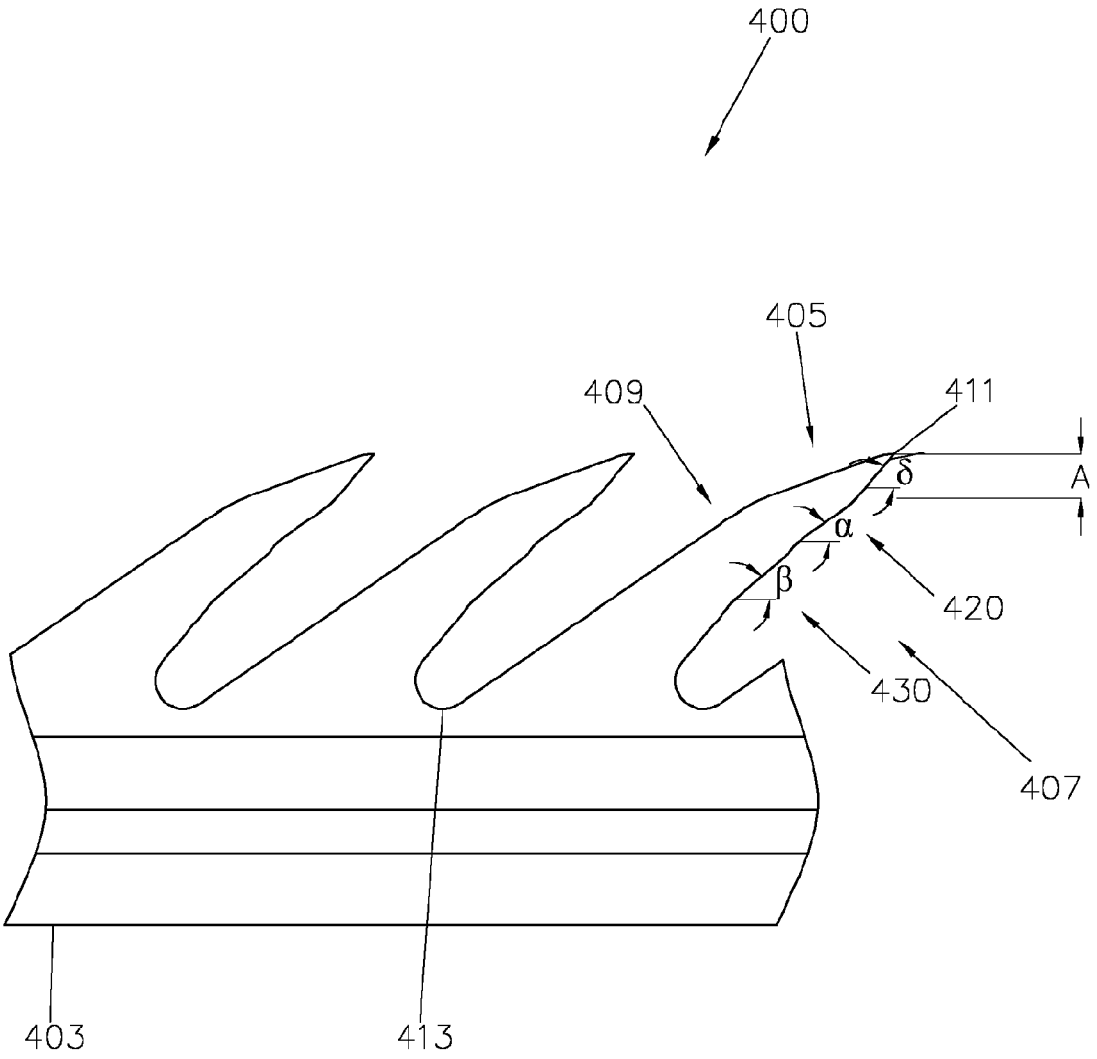
FIG. 4 shows a card wire according to the invention with two undercuts.

In a preferred embodiment, the card wire of the invention has two undercuts, more preferably exactly two undercuts. FIG. 4 shows a card wire 400 according to the invention that has two undercuts. The card wire 400 comprises a rib portion 403 and a plurality of teeth 405 along the length of the rib portion 403. The plurality of teeth 405 are inclined at an angle with respect to the rib portion 403. The teeth have a front portion 407 and a back portion 409. The front portion 407 is the inner portion of the tooth 405 leaning towards the rib portion 403. The back portion 409 is the outer portion of the tooth. The front portion 407 and the back portion 409 of the tooth join at the tip 411 of the tooth. The base segment 413 connects the front portion to the back portion 409 of the preceding tooth. The wire 400 has a first undercut segment 420 and a second undercut segment 430. Each undercut segment 420 and 430 has an undercut angle. The first (420) and second (430) undercut segment respectively have undercut angles α and β. As an example, α is 35 degrees and β is 40 degrees. In another example α is 35 degrees and β is 43 degrees.

Figure 5:
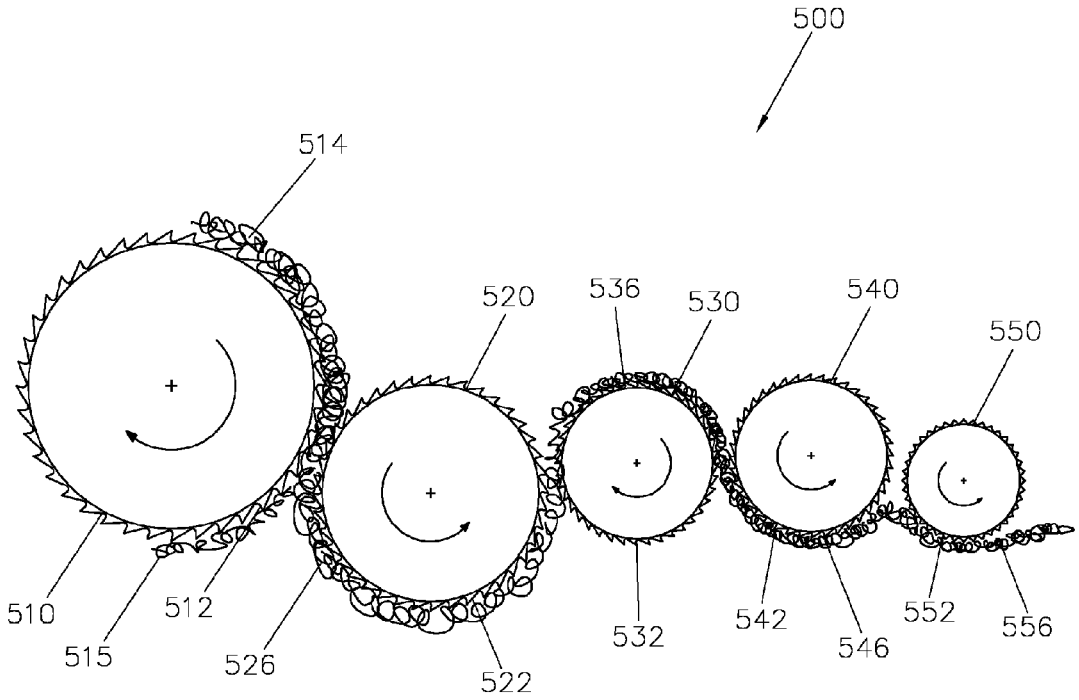
FIG. 5 shows an apparatus comprising rollers covered with card wire according to the invention.

FIG. 5 shows an apparatus 500 comprising a cylinder roller 510, a doffer roller 520 and two condenser rollers 530, 540 and a take-off roller 550. The apparatus 500 can be a part of a nonwoven card. The cylinder roller 510, the doffer roller 520 and the two condenser rollers 530, 540 and the take-off roller 550 are covered with card wire, respectively 512, 522, 532, 542 and 552. The first condenser roller 530 and/or the second condenser roller 540 can be covered with card wire according to invention, e.g. the card wires shown in FIG. 1, 3 or 4. In operation, the direction of rotation of the rollers is indicated by the arrows. The cylinder roller 510 carries a fiber web 514. At the intersection between the cylinder roller 510 and the doffer roller 520, part of the fiber web 514 is transferred from the card wire 512 of the cylinder roller 510 onto the card wire 522 of the doffer roller 520. The transferred fiber web is indicated by 526. However, the fiber web 514 is not completely transferred, a part of the fiber web 514, indicated with 515, is recycling on the cylinder roller 510.

The first condenser roller 530 rotates at a lower surface speed, e.g. 20% lower, than the doffer roller 520. The condenser roller 530 rotates in the direction opposite to the orientation of the front portion of the teeth of the card wire on the roller (the same applies for the direction of rotation of the doffer roller 520 and of the second condenser roller 540). The fiber web 526 is completely transferred from the doffer roller 520 to the first condenser roller 530, where it is carried by the teeth of its card wire 532 and where the fiber web is indicated with reference numeral 536. The second condenser roller 540 rotates at a lower surface speed, e.g. 20% lower, than the first condenser roller 530. The fiber web 536 is completely transferred from the first condenser roller 530 to the second condenser roller 540, where it is carried by the teeth of its card wire 542 and where the fiber web is indicated with reference numeral 536.

A take-off roller 550 covered with card wire 552 takes the web 546 off the second condenser roller 540 and transports the web 556 further.

By the action of the condenser rollers 530 and 540, the web is condensed, making it denser and reorienting the fibers.

The use of the card wire of the invention on the first and/or on the second condenser rollers eliminates the irregular bubbling or undulating appearance of the web in the intersection between the previous roller and the roller covered with card wire of the invention, without fiber loading occurring on the roller covered with the card wire of the invention.

The invention claimed is:

1. A card wire (100, 300, 400), comprising:

a rib portion (103, 303, 403); and a plurality of teeth (105, 305, 405) along a length of the rib portion (103, 303, 403), wherein the plurality of teeth (105, 305, 405) are inclined at an angle with respect to the rib portion (103, 303, 403), wherein the teeth have a front portion (107,307,407) and a back portion (109, 309, 409), wherein the front portion (107, 307, 407) is an inner portion of the tooth leaning towards the rib portion (103, 303, 403) and the back portion (109, 309, 409) is an outer portion of the tooth, wherein the front portion (107, 307, 407) and the back portion (109, 309, 409) of the tooth join at a tip of the tooth (111, 311, 411); wherein the teeth have a base segment (113, 313, 413) connecting the front portion (107, 307, 407) of one of the teeth to the back portion (109, 309, 409) of a preceding tooth;

wherein the front portion (107,307,407) comprises at least two undercut segments (120, 130; 320, 330; 420, 430) including a first undercut segment (120, 320, 420) and a second undercut segment (130, 330, 430);

wherein the second undercut segment (130, 330, 430) is spaced further away from the tip of the tooth (111, 311, 411) than the first undercut segment (120, 320,420);

wherein each undercut segment (120, 130; 320, 330; 420, 430) has an undercut angle (α, β);

wherein the undercut angle (α, β) is the minimum of the angles with a longitudinal direction of the card wire of the tangents to each point of the undercut segment going—when observed from the tip—inwards from the front portion (107, 307, 407);

wherein the second undercut segment (130, 330, 430) has a larger undercut angle (β) than the first undercut segment (α).

2. The card wire (100, 300, 400) of claim 1, wherein the difference between the undercut angle (β) of the second undercut segment (130, 330, 430) and the undercut angle (α) of the first undercut segment (120, 320, 420) is at least 8 degrees.

3. The card wire (100, 300, 400) of claim 1, wherein the first undercut segment (120, 320, 420) starts at a distance (A)—measured perpendicularly to the longitudinal direction of the card wire—from the tip of the tooth (111,311,411), of at least 0.15 mm.

4. The card wire (100, 300, 400) of claim 1, wherein the undercut angle (α) of the first undercut segment (120, 320, 420) is between 0 and 38 degrees.

5. The card wire (100, 300, 400) of claim 1, wherein the undercut angle (β) of the second undercut segment (130, 330, 430) is between 20 and 50 degrees.

6. The card wire (100) of claim 1, further comprising a third undercut segment (140) positioned further away from the tip of the tooth than the second undercut segment (130); and wherein the third undercut segment (140) has an undercut angle (y) which is larger than the undercut angle (β) of the second undercut segment (130).

7. The card wire (100) of claim 6, wherein the undercut angle (y) of the third undercut segment (140) is at least 8 degrees larger than the undercut angle (β) of the second undercut segment (130).

8. The card wire (100) of claim 6, wherein the undercut angle (y) of the third undercut segment (140) is between 30 and 50 degrees.

9. The card wire (100, 400) of claim 1, further comprising a linear part (161) in the front portion (107, 407) between the tip and the first undercut segment (120, 420).

10. The card wire (100, 400) of claim 9, wherein the linear part (161) of the front portion (107, 407) has an angle (δ) with the rib portion (103, 403) of the card wire between 20 and 65 degrees.

11. The card wire of claim 1, wherein at least one of the first undercut segment, or the second undercut segment comprise in a portion of the undercut segment going—when observed from the tip—inwards from the front portion a part that is substantially linear.

12. The card wire of claim 1, wherein at least one of the first undercut segment or the second undercut segment have a triangular shape or a scallop shape.

13. An apparatus comprising;

a condenser roller (530, 540);

wherein the condenser roller (530, 540) is covered with a card wire (100, 300, 400) as in claim 1;

wherein the condenser roller (530, 540) is arranged to rotate in a direction opposite to a direction of orientation of the front portion (107, 307, 407) of the teeth of the card wire on the condenser roller.

14. The apparatus of claim 13, comprising a further roller having a surface (520) covered with a card wire;

wherein the further roller is arranged to rotate so that the surface of the further roller closest to the surface of the condenser roller and the surface of the condenser roller closest to the surface of the further roller rotate in the same tangential direction; and wherein the condenser roller (530) is arranged to receive a web of fibers from the further roller (520).

15. The apparatus of claim 14, wherein the condenser roller (530) is configured to rotate at a lower surface speed than the further roller (520); and wherein the condenser roller (530) is configured to receive a full web of fibers present on the further roller (520).

16. A method of operating an apparatus comprising a condenser roller covered with a card wire comprising a rib portion and a plurality of teeth along a length of the rib portion, wherein the plurality of teeth are inclined at an angle with respect to the rib portion, wherein the teeth have a front portion and a back portion, wherein the front portion is an inner portion of the tooth leaning towards the rib portion and the back portion is an outer portion of the tooth, wherein the front portion and the back portion of the tooth join at a tip of the tooth, wherein the teeth have a base segment connecting the front portion of one of the teeth to the back portion of a preceding tooth, wherein the front portion comprises at least two undercut segments including a first undercut segment and a second undercut segment spaced further away from the tip of the tooth than the first undercut segment, wherein each undercut segment has an undercut angle ($\alpha$, $\beta$), wherein the undercut angle ($\alpha$, $\beta$) is the minimum of the angles with a longitudinal direction of the card wire of the tangents to each point of the undercut segment going—when observed from the tip—inwards from the front portion, wherein the second undercut segment has a larger undercut angle ($\beta$) than the first undercut segment ($\alpha$), wherein the condenser roller is arranged to rotate in a direction opposite to a direction of orientation of the front portion of the teeth of the card wire on the condenser roller, the method comprising:

rotating the condenser roller (530) at a lower surface speed than a further roller (520); and receiving by the condenser roller (530) a full web of fibers present on the further roller (520).

* * * * *